US008007298B2

(12) United States Patent
Komiyama et al.

(10) Patent No.: US 8,007,298 B2
(45) Date of Patent: Aug. 30, 2011

(54) ELECTRICAL CONNECTOR

(75) Inventors: Ryuichi Komiyama, Tokyo (JP); Kazushige Sakamaki, Tokyo (JP)

(73) Assignee: Tyco Electronics AMP K.K., Kanagawa-ken (JP)

( * ) Notice: Subject to any disclaimer, the term of this patent is extended or adjusted under 35 U.S.C. 154(b) by 0 days.

(21) Appl. No.: 12/525,183

(22) PCT Filed: Jan. 29, 2008

(86) PCT No.: PCT/JP2008/051307

§ 371 (c)(1), (2), (4) Date: Mar. 12, 2010

(87) PCT Pub. No.: WO2008/093676

PCT Pub. Date: Aug. 7, 2008

(65) Prior Publication Data

US 2010/0178791 A1 Jul. 15, 2010

(30) Foreign Application Priority Data

Jan. 31, 2007 (JP) ..... 2007-021149

(51) Int. Cl.
*H01R 13/62* (2006.01)

(52) U.S. Cl. ..... 439/157; 439/752

(58) Field of Classification Search ..... 439/752, 439/902, 70, 157, 347

See application file for complete search history.

(56) References Cited

U.S. PATENT DOCUMENTS 5,252,096 A * 10/1993 Okada ..... 439/752
5,299,958 A * 4/1994 Ohsumi ..... 439/752
5,464,356 A * 11/1995 Nebeshima et al. ..... 439/752
5,516,308 A * 5/1996 Yamanashi ..... 439/752
5,782,657 A * 7/1998 Wolla et al. ..... 439/595
5,839,923 A * 11/1998 Yoshida ..... 439/752
6,648,699 B1 * 11/2003 Makino et al. ..... 439/752
6,902,443 B2 * 6/2005 Hara et al. ..... 439/752
6,935,904 B2 * 8/2005 Ishiyama ..... 439/752
7,086,910 B2 * 8/2006 Tanaka et al. ..... 439/752
7,347,744 B2 * 3/2008 Tabata et al. ..... 439/752
7,500,887 B2 * 3/2009 Ichio ..... 439/752
7,553,197 B2 * 6/2009 Mizutani ..... 439/686

(Continued)

FOREIGN PATENT DOCUMENTS

JP 8-248271 9/1996

(Continued)

OTHER PUBLICATIONS

PCT WO 2008/093673 A1 Search Report dated Aug. 7, 2008, 33 pages.

(Continued)

*Primary Examiner* — T C Patel
*Assistant Examiner* — Harshad C Patel
(74) *Attorney, Agent, or Firm* — Barley Snyder LLC

(57) ABSTRACT

There is provided an electrical connector in which the retaining force of retaining a front cover is improved. Electrical connectors 1, and 1' each have a housing 10 having contact accommodating cavities 13; a front cover 20 that is attached to the front side of the housing 10 and that has mating connector inserting openings 24 at positions that correspond to the contact accommodating cavities 13; and a retainer 30 that is attached form the lower side of the housing 10 and that locks contacts accommodated in the contact accommodating cavities 13. Retaining means 27, 28, 32, and 33 is arranged at the front cover 20 and the retainer 30 to cause the retainer 30 to retain the front cover 20.

16 Claims, 11 Drawing Sheets

U.S. PATENT DOCUMENTS

| | | | | |
|---|---|---|---|---|
| 7,828,607 | B2 * | 11/2010 | Kojima | 439/752 |
| 2003/0096539 | A1 * | 5/2003 | Ichio | 439/752 |
| 2008/0020639 | A1 * | 1/2008 | Ichio | 439/595 |

FOREIGN PATENT DOCUMENTS

| | | | |
|---|---|---|---|
| JP | PAJ 08-248271 | | 9/1996 |
| JP | 2000-315546 | A | 11/2000 |
| JP | PAJ 2000-315546 | | 11/2000 |
| JP | 2003-163050 | A | 6/2003 |
| JP | PAJ 2003-163050 | | 6/2003 |

OTHER PUBLICATIONS

International Preliminary Report, PCT/JP2008/051307 dated Aug. 13, 2009, (7 pages).

* cited by examiner

ELECTRICAL CONNECTOR

CROSS-REFERENCE TO RELATED APPLICATIONS

This application is a national stage filing of PCT International Application No. PCT/JP2008/051307, filed Jan. 29, 2008, which claims priority under 35 U.S.C. §119 to Japanese Patent Application No. JP 2007-021149, filed Jan. 31, 2007.

FIELD OF INVENTION

The present invention relates to an electrical connector having a housing that includes contact receiving cavities, a front cover attached to the front side of the housing and includes insertion openings into which the mating contacts are inserted, at a position opposite to the contact receiving cavities, and a retainer that locks contacts in the contact receiving cavities.

BACKGROUND

Conventionally, there is known an electrical connector having a housing, a front cover, and a retainer, as shown in FIG. 11 and FIG. 12. FIG. 11 is an exploded perspective view of a conventional electrical connector. FIG. 12 is a partial cross-sectional view of the housing included in the electrical connector.

An electrical connector 101, shown in FIG. 11, is provided with a housing 110, a retainer 120, and a front cover 130.

The housing 110 is formed by molding an insulating resin to have a substantial rectangular parallelepiped shape, and includes multiple contact receiving cavities 111 arranged in two stages in the widthwise direction of the housing 110. Each of the contact receiving cavities 111 is provided with a housing lance 114 to primarily lock a female contact 116, as shown in FIG. 12. In order to form the housing lances 114, as shown in FIG. 12, a lance forming opening 114*a* is arranged from the front surface (left-side surface in FIG. 12) of the housing 110 to extend rearward. A retainer receiving depression 115 is also arranged from the bottom surface of the housing 110 to extend upward. Moreover, the front surface of the housing 110 has a cover receiving depression 112, and the bottom surface of the cover receiving depression 112 has a pair of engaging dimples 113.

In addition, the retainer 120 is attached to the retainer receiving depression 115 of the housing 110 from the bottom side of the housing 110, so that the contacts 116 first locked by the housing lances 114 are further locked (secondarily) by terminal locks 121, with the terminal locks 121 are arranged at the front surface of the retainer 120. Pairs of first and second protrusions 123 and 124 are integrally provided at the front upper side and at the rear middle of both of side walls 122 of the retainer 120, respectively. The retainer 120 attached to the retainer receiving depression 115 is latched in the retainer receiving depression 115 by the first and second protrusions 123 and 124.

Furthermore, the front cover 130 is attached to the cover receiving depression 112 of the housing 110 from the front side of the housing 110. The front cover 130 has multiple mating terminal insertion holes 131 located at positions opposite to the contact receiving cavities 111, respectively. Then, tool insertion holes 132, into which a tool (not shown) for removing the contacts 116 by operating the housing lance 114 is inserted, are respectively arranged below the mating terminal insertion holes 131. Also, a pair of protrusions, not shown, are provided at both sides of the bottom surface of the front cover 130, so that the protrusions are latched by the engaging dimples 113 provided with the housing 110.

The front cover 130 is formed separately from the housing 110 as described above, for the following reasons. To form the housing lances 114 integrally with the housing 110, together with a portion corresponding to the front cover 130, it is necessary to make lance forming openings 114*a* for inserting molds for forming the housing lances 114 from the front surface of the housing 110 to the housing lances 114. If the housing 110 is of large size and relatively large gaps are ensured between the mating terminal insertion holes 131 adjacently arranged at the front surface of the housing 110, the lance forming openings 114*a* can be formed from the front surface of the housing 110, in addition to the mating terminal insertion holes 131. However, if the housing 110 is downsized and the gaps between the mating terminal insertion holes 131 adjacently arranged are made smaller at the front surface of the housing 110, it may be impossible to ensure a space for forming the lance forming openings 114*a* from the front surface of the housing 110. For these reasons, the housing lance 114 is integrally formed with the housing 110, whereas the part in which the mating terminal insertion holes 131 are formed is arranged at the front cover 130 separately provided from the housing 110.

Referring to FIG. 12, without the front cover 130, a mating male terminal 141 provided at a mating connector 140 would be inserted into the lance forming opening 114*a* or the mating male terminal 141 would reach and touch the contact 116, in some cases, when the mating connector 140 is mated with the electrical connector 110. The provision of the front cover 130 allows the mating male terminal 141 to guide through the mating terminal insertion holes 131 to the contacts 116 in an appropriate manner, and also allows the tool to guide through the tool insertion holes 132 arranged at the front cover 130 to the housing lance 114 in an appropriate manner.

It should be noted, however, the electrical connector 101 shown in FIG. 11 and FIG. 12 has the following drawbacks.

That is to say, the front cover 130 is attached to the cover receiving depression 112 only in a case where a pair of protrusions (not shown) arranged at both sides of the bottom surface are latched by the engaging dimples 113 provided with the housing 110. Accordingly, the retaining force of retaining the front cover 130 is very weak. For this reason, if the electrical connector 101 is dropped off, or if the mating connector 140 is removed after the electrical connector 101 and the mating connector 140 are mated with each other, the front cover 130 will come off from the housing 110 in some cases.

Meanwhile, the number of the protrusions provided at the front cover 130 and the number of the engaging dimples 113 provided with the housing 110 are increased for enhancing the retaining force of retaining the front cover 130. However, if the number of the protrusions provided at the front cover 130 and the number of the engaging openings 113 provided with the housing 110 are increased, the front cover 130 and the housing 110 will be upsized. This goes against the need for downsizing the whole electrical connector 101. Therefore, in the electrical connector 101 shown in FIG. 11 and FIG. 12, it is impossible to arrange at the front cover 130 and the housing 110 a number of members for locking the front cover 130 to the housing 110.

SUMMARY

The present invention has been made in view of the above circumstances and is an object of the present invention is to provide an electrical connector in which the retaining force of retaining a front cover is improved. The electrical connector includes a housing having contact receiving cavities, a front cover that is attached to the front side of the housing and that has mating connector inserting openings at positions that correspond to the contact receiving cavities, and a retainer that is attached form the lower side of the housing and that locks contacts accommodated in the contact receiving cavities, wherein a retaining mechanism is arranged at the front cover and the retainer to cause the retainer to retain the front cover.

BRIEF DESCRIPTION OF THE DRAWINGS

FIG. 2A illustrates a state before a mating connector is mated, and FIG. 2B illustrates a state after the mating connector is mated;

FIG. 3A illustrates a front view, and FIG. 3B illustrates a cross-sectional view taken along line 3B-3B of FIG. 3A;

FIG. 4A illustrates a cross-sectional view taken along line 4A-4A, and FIG. 4B illustrates a cross-sectional view taken along line 4B-4B of FIG. 4A;

FIG. 5A illustrates a rear view, and FIG. 5B illustrates a bottom view;

FIG. 6A illustrates a cross-sectional view taken along line 6A-6A of FIG. 5B, FIG. 6B illustrates a cross-sectional view taken along line 6B-6B of FIG. 5B, and FIG. 6C illustrates a partial enlarged view of FIG. 5B;

FIG. 7A illustrates a rear view, FIG. 7B illustrates a cross-sectional view taken along line 7B-7B of FIG. 7A, FIG. 7C illustrates a cross-sectional view taken along line 7C-7C of FIG. 7A, and FIG. 7D illustrates a cross-sectional view taken along line 7D-7D of FIG. 7A;

FIG. 9A illustrates a cross-sectional view the electrical connector cut away from the side surface side (cross-sectional view that is cut away from a line same as the line 4B-4B of FIG. 3A), FIG. 9B illustrates a cross-sectional view of the connector cut away from the front surface side, and FIG. 9C illustrates a cross-sectional view of the connector cut away from the flat surface side;

FIG. 10A illustrates a cross-sectional view the electrical connector cut away from the side surface side, and FIG. 10B illustrates a cross-sectional view of the connector cut away from the front surface side;

DETAILED DESCRIPTION OF THE EMBODIMENT(S)

The embodiments of the present invention will now be described based on the accompanying drawings.

Figure 1:
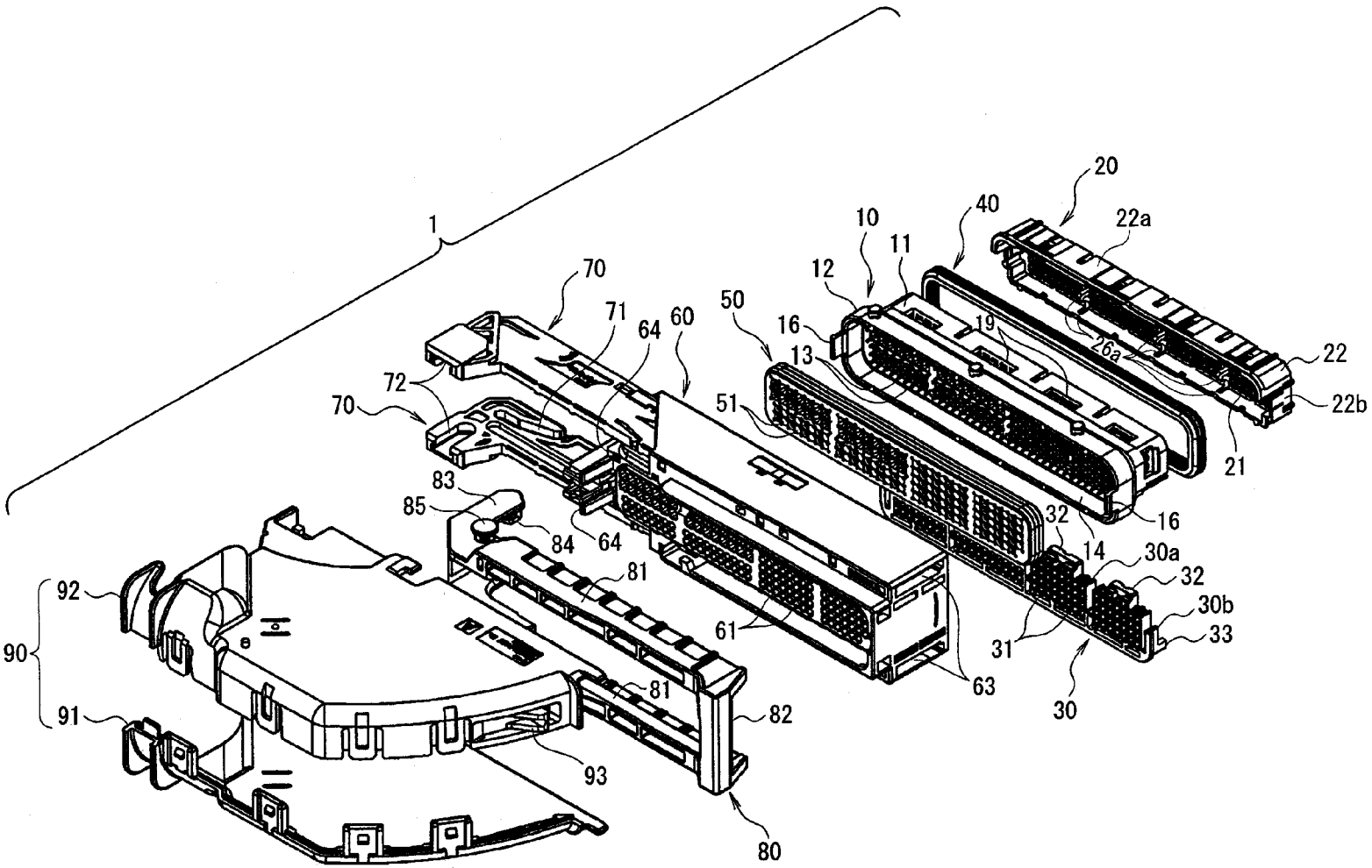
FIG. 1 is an exploded perspective view of an electrical connector according to the present invention.

An electrical connector 1, as illustrated in FIG. 1, is what is called a lever-type connector, and is provided with an inner housing 10, a front cover 20, a retainer 30, a first seal 40, a second seal 50, an outer housing 60, a pair of sliders 70, a lever 80, and a wire cover 90.

The inner housing 10 is integrally formed by molding an insulating resin. As illustrated in FIGS. 1, 4-6, the inner housing 10 is provided with a housing main body 11 having a substantial rectangular parallelepiped shape that extends in the widthwise direction (horizontal direction of FIG. 5A), in the vertical direction (up-and-down direction of FIG. 5A), and in the front-rear direction (up-and-down direction of FIG. 5B), as well as a hood 12 that extends rearward from the housing main body 11. The housing main body 11 has multiple contact receiving cavities 13 that penetrate through the housing main body 11 in the front-rear direction. An inner space of the hood 12 defines a second seal receiving space 14. Each of the contact receiving cavities 13 is provided with a housing lance 15 for principally locking a contact, not illustrated.

Figure 4A:
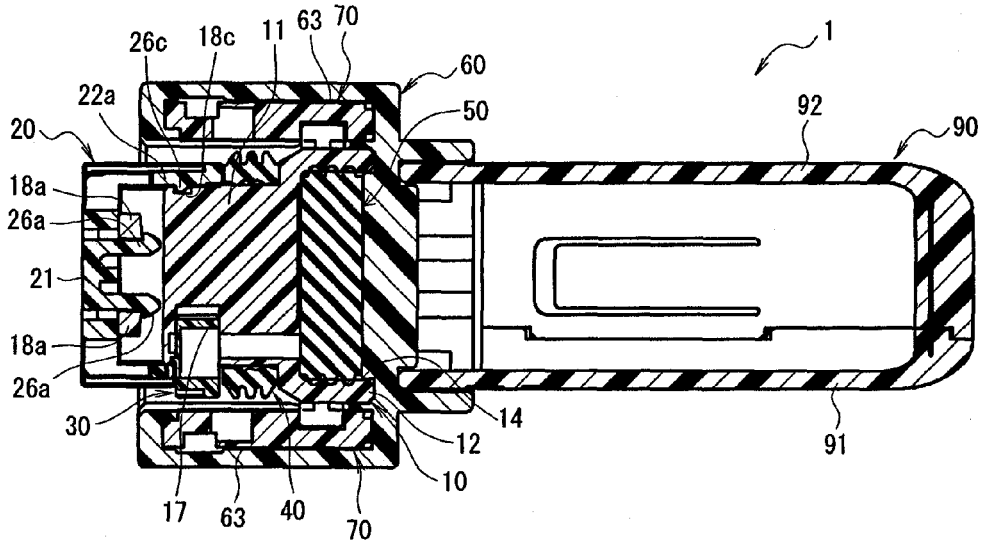
FIGS. 4A and 4B illustrate the electrical connector of FIG. 1, whereby
Figure 4B:
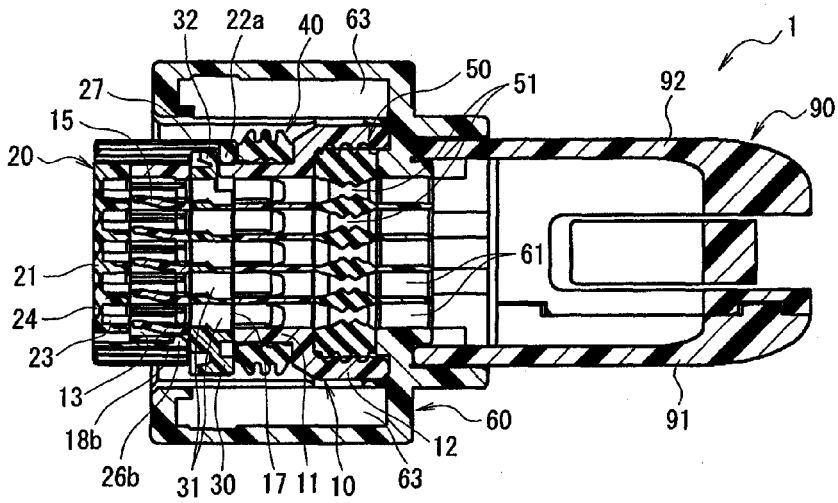
Figure 5A:
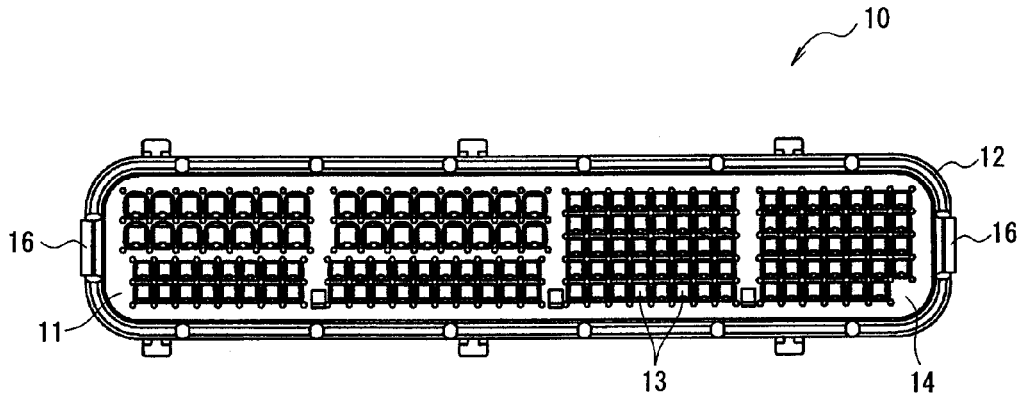
FIGS. 5A and 5B illustrate an inner housing, whereby
Figure 5B:
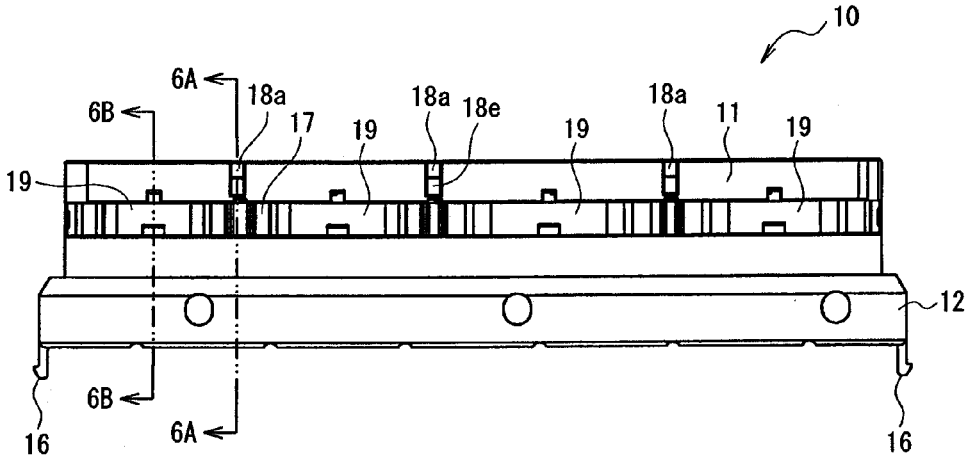
Figure 6A:
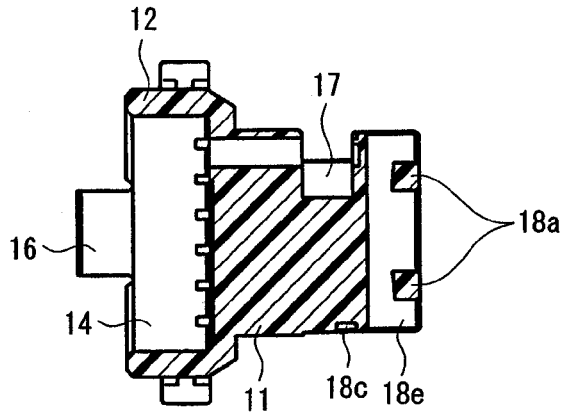
FIGS. 6A to 6C illustrate the inner housing of FIG. 5B, whereby
Figure 6B:
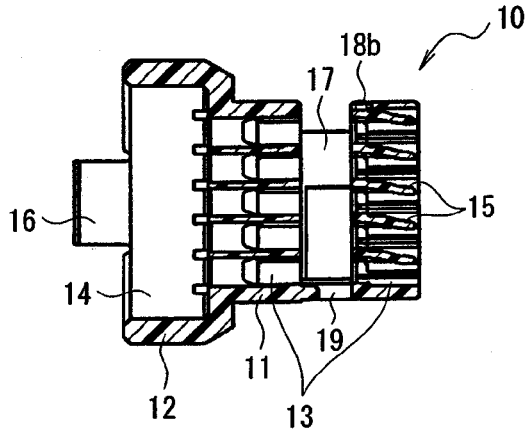
Figure 6C:
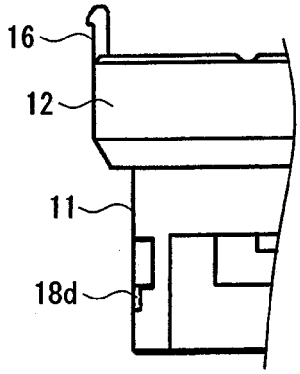

Then, the housing main body 11 is provided with a retainer receiving depression 17 that opens downward and extends upward (opens upward in FIG. 6) as illustrated in FIG. 4A, FIG. 4B, FIG. 6A, and FIG. 6B. The top surface of the retainer receiving depression 17 has multiple housing openings 19, as illustrated in FIG. 1, FIG. 5B, and FIG. 6B. Front cover retaining protrusions 32, to be described later, of the retainer 30 penetrate through the housing openings 19, respectively, and protrude above the upper side of the housing main body 11.

Also, a pair of housing latch arms 16 for latching the inner housing 10 with the outer housing 60 are provided to protrude rearward at both end portions in the widthwise direction of the hood 12 in the inner housing 10, as illustrated in FIG. 1. On the other hand, the front surface of the housing main body 11 of the inner housing 10 is provided with multiple grooves 18*e* that penetrate through in up-and-down direction, as illustrated in FIG. 5B and FIG. 6A. The front end portion of each groove 18*e* is provided with a pair of housing latching portions 18*a* to be latched by front cover elastic latch arms 26*a* and arranged at a given interval in the up-and-down direction, as illustrated in FIG. 4A. Each of the housing latching portions 18*a* is arranged to cross the depression 18*d*. In addition, the front side of the retainer receiving depression 17 of the housing main body 11, that is, the bottom surface of the housing main body 11, is provided with multiple cutouts 18*b* with which second elastic latch arms 26*b* provided with the front cover 20 is latched, as illustrated in FIG. 4B and FIG. 6B. Furthermore, the top surface of the housing main body 11 includes the depression 18*c* into which a projection 26*c*, arranged with the front cover 20, enters, as illustrated in FIG. 4A and FIG. 6A. Moreover, both side walls 22*b* in the widthwise direction of the housing main body 11 include locking depressions 18*d* to be respectively locked by elastic side locks 26*d*, which are provided with the front cover 20.

The front cover 20 is attached to the front side of the inner housing 10. As illustrated in FIG. 1, FIG. 7A, FIG. 7B, and FIG. 7C, the front cover 20 is provided with a main body 21 that extends in the widthwise direction to cover the front surface of the housing main body 11. The front cover 20 is formed by molding an insulating resin. The rear surface of the main body 21 includes a hood 22 that extends rearward to cover the top surface of the housing main body 11 and both side surfaces in the widthwise direction of the housing main body 11.

Figure 7A:
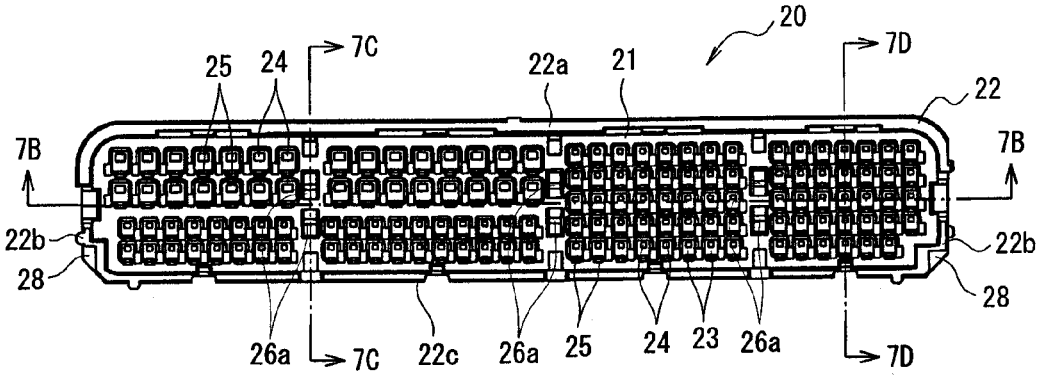
FIGS. 7A to 7D illustrate a front cover, whereby
Figure 7B:
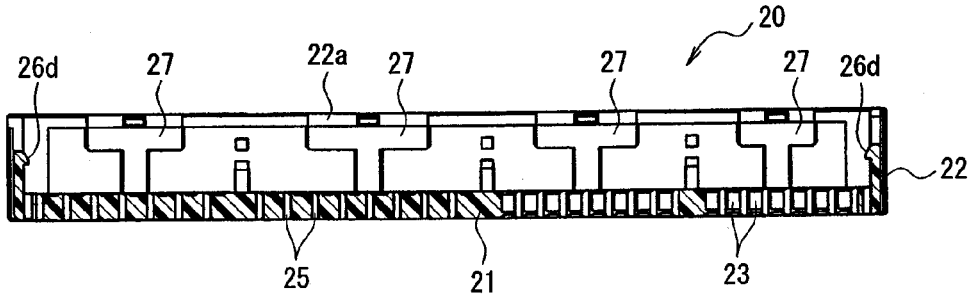
Figure 7C:
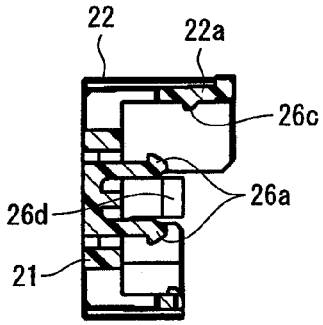
Figure 7D:
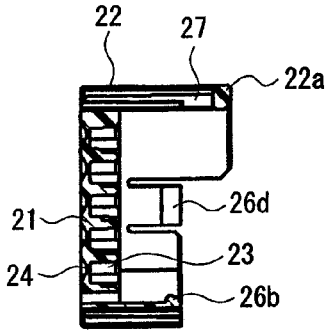

In this situation, the rear surface of the main body 21 of the front cover 20, as illustrated in FIG. 4B, FIG. 7A and FIG. 7D, includes multiple contact receiving chambers 23 that are defined at positions corresponding to the contact receiving cavities 13. In addition, the front surface of the main body 21 has multiple mating terminal insertion openings 24 that communicate with the contact receiving chambers 23, respectively, at positions that correspond to the contact receiving cavities 13 defined in the housing main body 11. Furthermore, tool openings 25, into which a tool (not illustrated) for removing the contacts (not illustrated), by functioning the housing lance 15, are arranged at the front surface of the main body 21 and below the mating terminal insertion openings 24, respectively.

The design of the front cover 20 allows the electrical connector 1 to be downsized, and additionally avoids certain drawbacks such as when the mating terminals provided at the mating connector touch the contacts when the mating connector (not illustrated) and the electrical connector 1 are mated with each other. That is to say, it is possible to protect the contacts accommodated in the inner housing 10.

The main body 21 of the front cover 20 is provided with multiple pairs of front cover elastic latch arms 26*a* that protrude rearward at given intervals in the widthwise direction. Each pair of the front cover elastic latch arms 26*a*, as illustrated in FIG. 4A, are inserted between each pair of the housing latching portions 18*a*, to be latched by the housing latching portions 18*a*. Each pair of the front cover elastic latch arms 26*a* are arranged at a given interval in the up-and-down direction. In addition, the lower part of the main body 21 in the front cover 20 is provided with multiple second elastic latch arms 26*b* to be latched by the cutouts 18*b* arranged in the inner housing 10, as illustrated in FIG. 4B and FIG. 7D. Furthermore, an upper wall 22*a* of the hood 22 in the front cover 20 is provided with the projection 26*c* to be inserted into the depression 18*c*, which is arranged with the inner housing 10, as illustrated in FIG. 4A and FIG. 7C. Moreover, both side walls 22*b* of the hood 22 in the front cover 20 are provided with a pair of elastic side locks 26 to be locked by the locking depressions 18*d* of the inner housing 10.

Figure 10A:
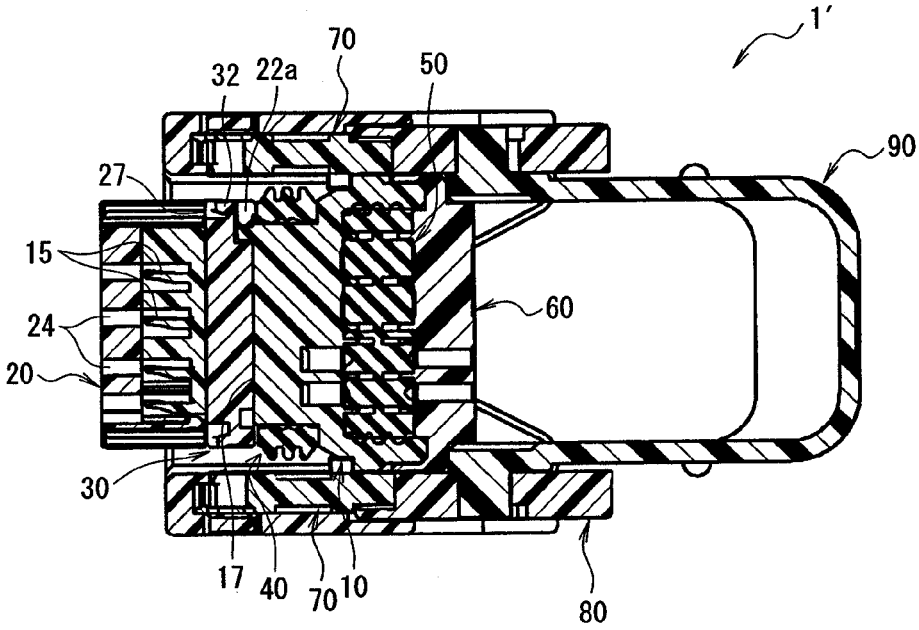
FIGS. 10A and 10B illustrate the electrical connector of FIG. 8 in a state where a retainer is located at a proper locking position.
Figure 10B:
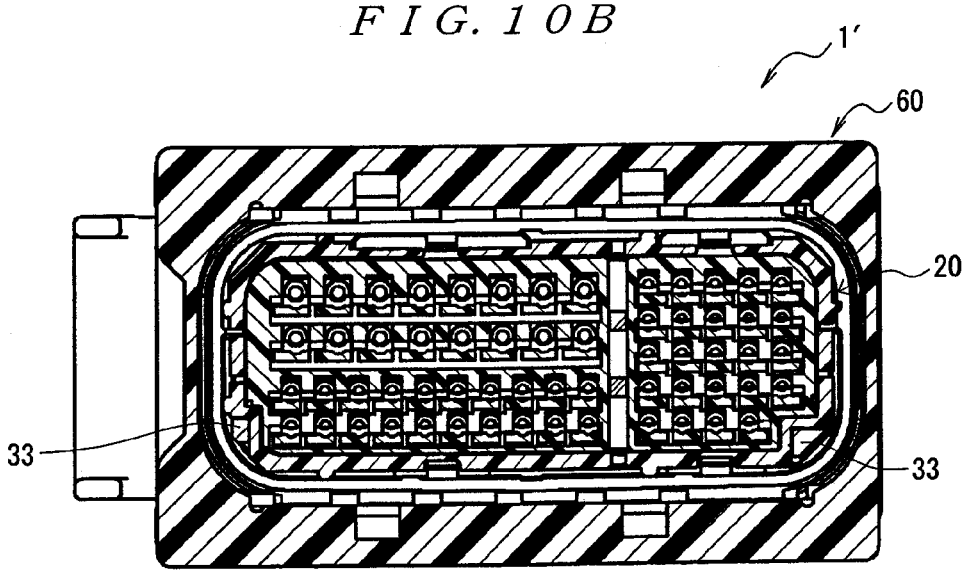
Figure 11:
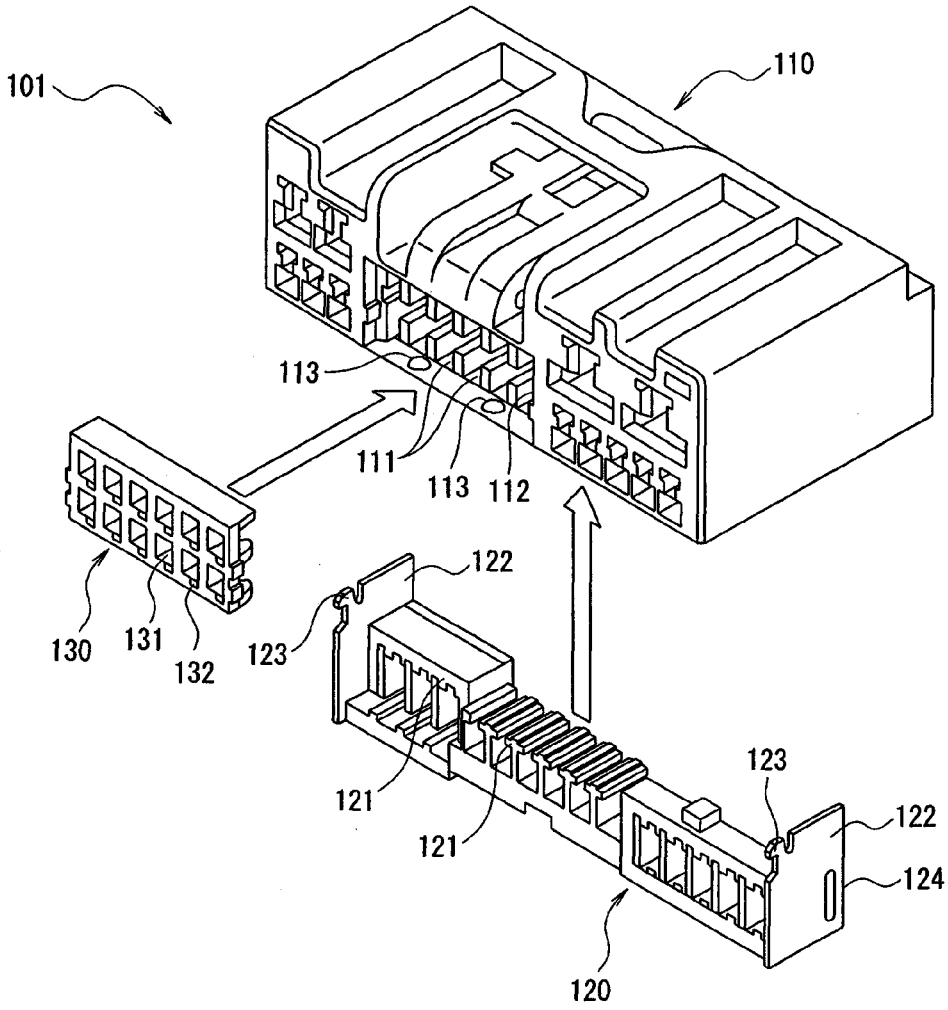
FIG. 11 illustrates an exploded perspective view of a known conventional electrical connector.
Figure 12:
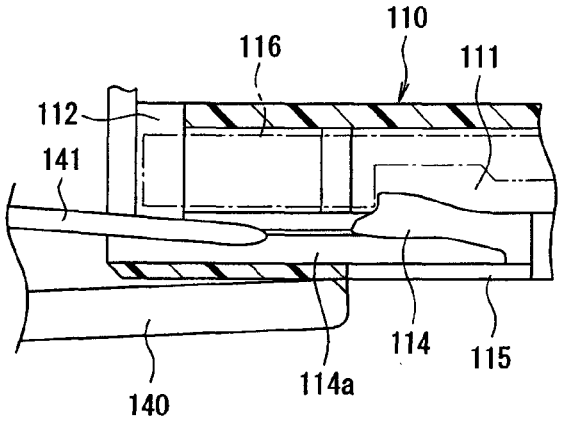
FIG. 12 is a partial cross-sectional view of a housing included in the known conventional electrical connector of FIG. 11.

Further, the upper wall 22*a* of the hood 22 in the front cover 20 is provided with multiple front cover openings 27, through which the front cover retaining protrusions 32, to be described later, of the retainer 30 are inserted, respectively, as illustrated in FIG. 4B and FIG. 7B. Into each of the multiple front cover openings 27, the front cover retaining protrusions 32 are penetrated through the multiple front cover openings 27, respectively, when the retainer 30 is attached to the inner housing 10, so as to regulate the front-rear movement of the front cover 20, as illustrated in FIG. 10A (FIGS. 10A and 10B illustrate a second embodiment of the electrical connector 1 with the front cover openings 27 having the same functions). Also, projection portions 28 that project outward are arranged at the lower part of both of side walls 22*b* of the hood 22 in the front cover 20, as illustrated in FIG. 7A.

Next, the retainer 30 is attached to the retainer receiving depression 17 from the lower side of the inner housing 10, and is formed to have a substantial plate shape that extends in the widthwise direction, as illustrated in FIG. 1, FIG. 4A and FIG. 4B. The retainer 30 is temporarily locked by the inner housing 10 at a temporary locking position shown in FIG. 4A and FIG. 4B. Subsequently, the retainer 30 is further pushed from the temporary locking position, and properly locks contacts (not illustrated) in the inner housing 10 at a proper locking position (not illustrated). The proper locking state of the retainer 30 denotes a state where the retainer 30 is completely pushed into the inner housing 10.

Figure 9A:
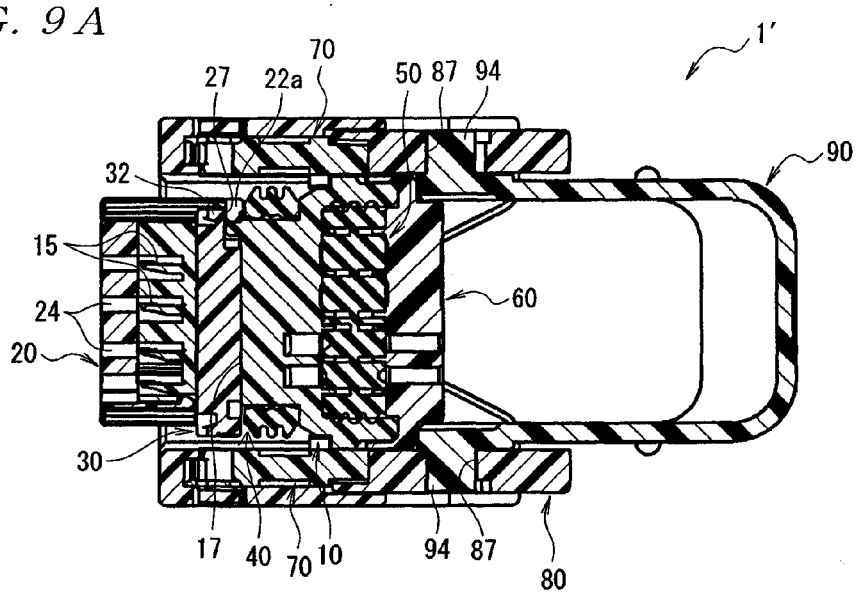
FIGS. 9A to 9C illustrate the electrical connector of FIG. 8 in a state where a retainer is located at a temporary position, whereby
Figure 9B:
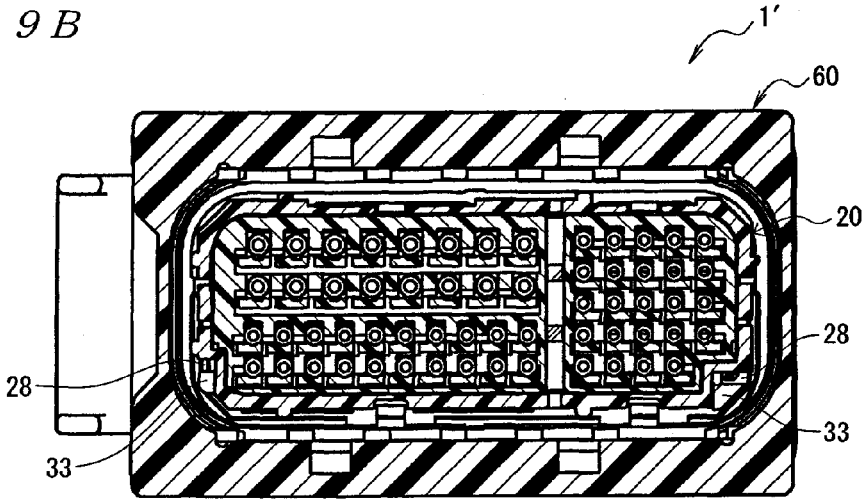
Figure 9C:
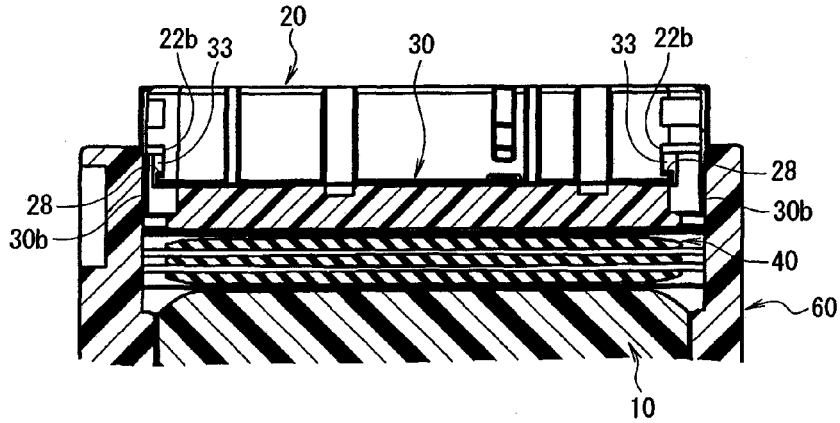

The retainer 30 is formed by molding an insulating resin, and includes multiple contact insertion openings 31 to correspond to the contact receiving cavities 13, respectively, arranged with the housing main body 11. An upper end surface 30*a* of the retainer 30 is provided with multiple front cover retaining projections 32 to project upward. Also, a pair of retaining pieces 33 are arranged at the lower part of both of side walls 30*b* of the retainer 30, as illustrated in FIG. 1 (only one retaining piece 33 provided at one of side walls 22*b* is illustrated in FIG. 1). In FIG. 9B and FIG. 9C, these retaining pieces 33 retain the projection portions 28, when the retainer 30 is attached to inner housing 10, so as to regulate the front-rear movement of the front cover 20. FIGS. 9A to 9C illustrate a second embodiment of the electrical connector 1 with the retaining pieces 33 having the same functions.

The electrical connector 1 includes a retaining mechanism, which for purposes of detailing the present invention, may include front cover retaining protrusions 32 provided at the retainer 30, front cover openings 27 arranged along the upper wall 22*a* in the front cover 20, projection portions 28 arranged along the lower part of both of the side walls 22*b* in the front cover 20, and retaining pieces 33 arranged at the lower part of both of the side walls 30*b* of the retainer 30. The retaining mechanism, as used in the present invention, is a combination of arranged parts.

When the retainer 30 is located at the temporary locking position, the contacts, not illustrated, are inserted into the contact receiving cavities 13, respectively, so that the contacts are principally locked by the housing lance 15. Then, when the retainer 30 is made to move to the proper locking position, the contacts are consequently locked to the inner housing 10 by the retainer 30.

Also, the first seal 40 is formed to have a ring shape, as illustrated in FIG. 1, FIG. 4A, and FIG. 4B, to be tightly attached to the exterior of the housing main body 11 in the inner housing 10. When the mating connector (not illustrated) is mated with the electrical connector 1, the first seal 40 seals between the mating connector and the housing main body 11, and has a function of preventing water from entering into the inner housing 10 from the mating portion.

In addition, the second seal 50 is formed to have a substantial plate shape, as illustrated in FIG. 1, FIG. 4A, and FIG. 4B, to be accommodated in a second seal receiving space 14 of the hood 12 in the inner housing 10, and is tightly attached to the inner circumferential surface of the hood 12. Multiple electrical wire inserting openings 51 are defined at the second seal 50, as illustrated in FIG. 1 and FIG. 4B, at positions that correspond to the contact receiving cavities 13, respectively. Electric wires (not illustrated) connected to the contacts accommodated in the contact receiving cavities 13 are extended rearward via the electrical wire inserting openings 51. However, the sealed part in the inner circumference of the electrical wire inserting opening 51 is tightly attached to the external circumferential surface of the electrical wire so as to prevent water from entering into the inner housing 10 from the electrical wire inserting opening 51.

Figure 3A:
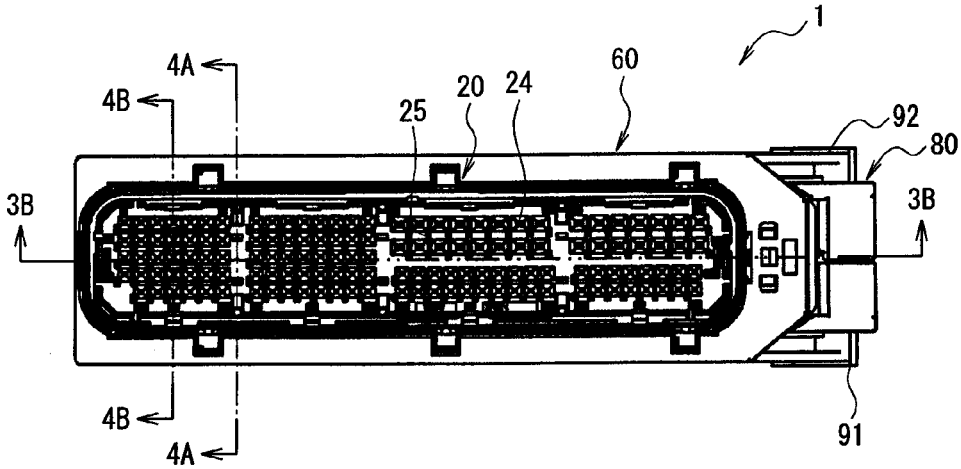
FIGS. 3A and 3B illustrate the electrical connector of FIG. 1, whereby
Figure 3B:
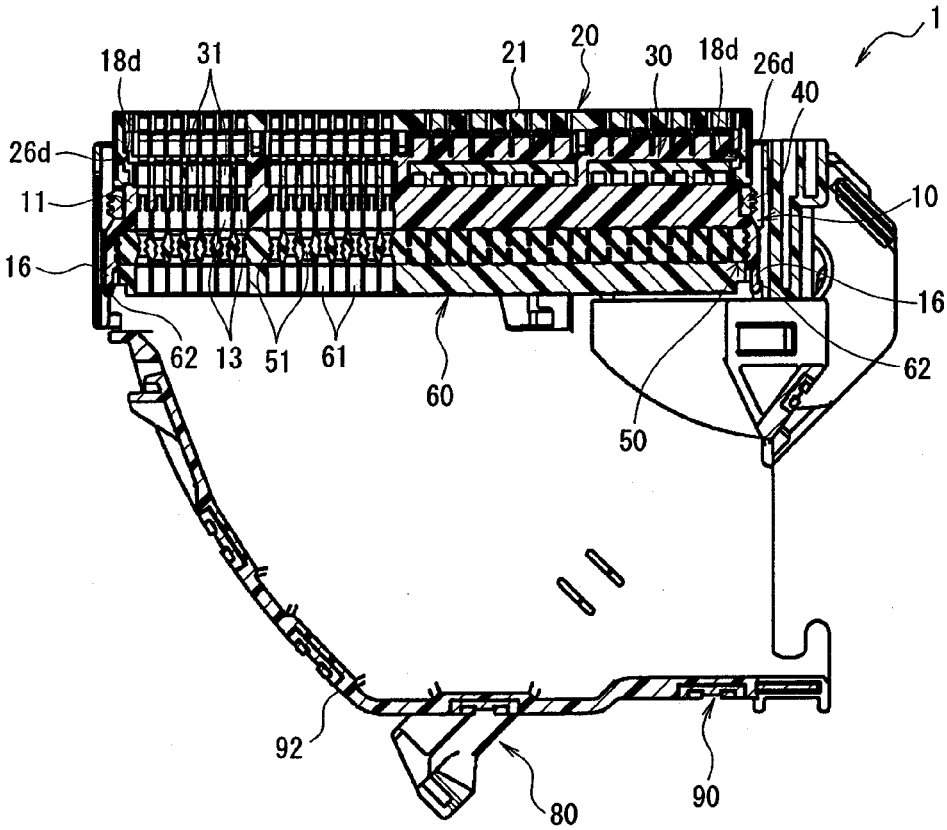

Furthermore, the outer housing 60 is integrally formed by molding an insulating resin to have a substantial rectangular parallelepiped shape that extends in the widthwise direction, in the up-and-down direction, and in the front-rear direction, as illustrated in FIG. 1. Multiple electrical wire extending openings 61 are defined at the outer housing 60, at positions that correspond to the contact receiving cavities 13, as illustrated in FIG. 4B. Additionally, a pair of slider receiving grooves 63 that extend in the widthwise direction are defined at both of up and down sides of the outer housing 60, as illustrated in FIG. 4B. Further, as illustrated in FIG. 3B, there is provided at the rear surface of the outer housing 60 a latch arm receiving engagement 62 to be engaged by the housing latch arms 16 provided in the inner housing 10.

Moreover, each of the sliders 70 is formed to have a substantial plate shape, and is movably accommodated in the slider receiving groove 63 of the outer housing 60. A cam groove 71 is defined at the inner surface of each slider 70, as illustrated in FIG. 1, so that a cam pin (not illustrated) is provided at the mating connector to enter into the cam groove 71. Also, slider depressions 72 are defined at one end portion of the inner surface of each slider 70, so that a protrusion for slider movement 85, to be described later, arranged at the lever 80 is fit into the slider depressions 72.

Figure 2A:
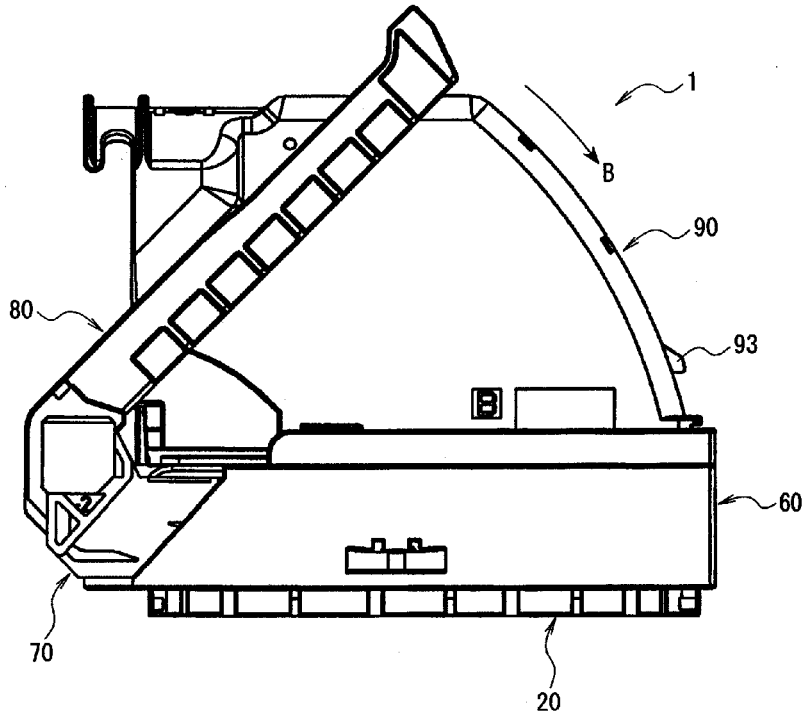
FIGS. 2A and 2B illustrate the electrical connector of FIG. 1, whereby
Figure 2B:
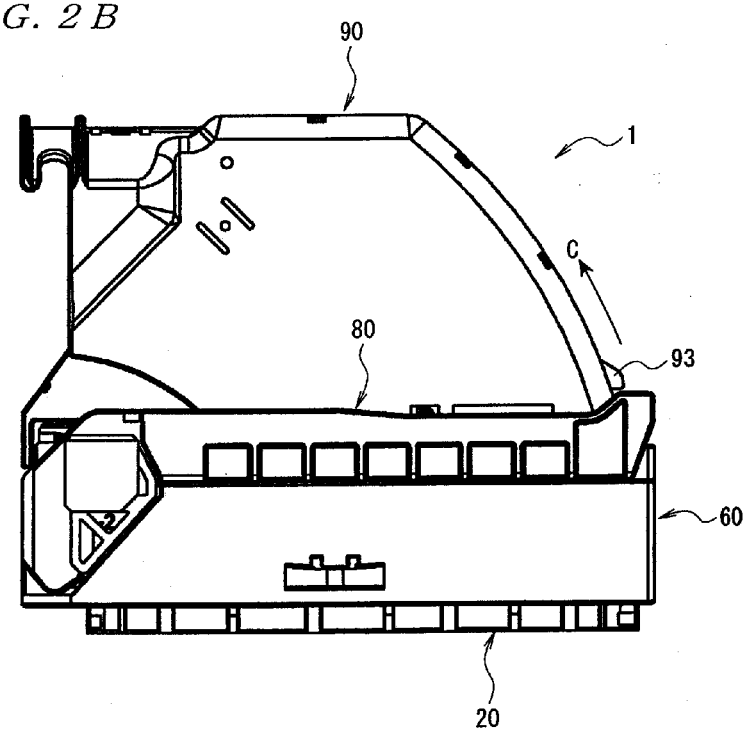

Moreover, as illustrated in FIG. 1, the lever 80 is provided with a pair of arms 81 and a connector 82 that connect ends of the arms 81 with each other. Each of the other ends of the arms 81 is provided with an extension 83 that extends orthogonally, and a pivot 84 is formed to protrude at the inner surface of an end of each extension 83. Also, the external surface of the other end of each of the arms 81 is provided with the protrusion for slider movement 85 that is fit into the slider depressions 72 of each slider 70. The pivot 84 of the lever 80 is fit into a pivot receiving portion 64 arranged at one end portion in the widthwise direction of the outer housing 60, in order to turn the lever 80 both in an arrow B direction as illustrated in FIG. 2A and in an arrow C direction as illustrated in FIG. 2B, with respect to the outer housing 60. When the lever 80 turns in the arrow B direction, the sliders 70 move in a direction where the sliders 70 are accommodated in the slider receiving grooves 63 of the outer housing 60. Conversely, when the lever 80 moves in the arrow C direction, the sliders 70 move in a direction where the sliders 70 come out of the slider receiving grooves 63. When the lever 80 turns in the arrow B direction from the state illustrated in FIG. 2A and the sliders 70 (arranged at the mating connector) move in the direction where the sliders 70 are accommodated in the slider receiving grooves 63, the cam pin (provided at the mating connector) is pulled to the electrical connector 1 side along the cam grooves 71 of the sliders 70 so that the mating connector is mated with the electrical connector 1. Conversely, when the lever 80 turns in the arrow C direction from the state illustrated in FIG. 2B and then the sliders 70 come out of the slider receiving grooves 63, the cam pin provided at the mating connector moves in the direction of moving away from the electrical connector 1 and then mating of the mating connector and the electrical connector 1 is released.

Furthermore, as illustrated in FIG. 1, the wire cover 90 includes a lower cover 91 and an upper cover 92 that is attached to the lower cover 91. The wire cover 90 is attached to the rear side of the outer housing 60, so that multiple electrical wires extended from the electrical wire extending openings 61 of the outer housing 60 are further extended to one side of the outer housing 60, in the widthwise direction. As illustrated in FIG. 2B, the lever 80 turns in the arrow B direction until it is then located at the final position, while the upper cover 92 is provided with a lock 93 that prevents the lever 80 from turning in the arrow C direction.

Next, an assembling method of the electrical connector 1 will be described.

At the time of initiating the assembling of the electrical connector 1, the first seal 40 is firstly attached to the exterior of the housing main body 11 of inner housing 10.

Subsequently, the front cover 20 is attached to the front side of inner housing 10. In this situation, and as illustrated in FIG. 4A, each pair of the front cover elastic latch arms 26*a* are inserted between each pair of the housing latching portions 18*a* arranged at the inner housing 10, and are then latched by the housing latching portions 18*a*, respectively. Also, as illustrated in FIG. 4A, the projection 26*c* arranged at the front cover 20 enters into the depression 18*c* arranged at the inner housing 10. In addition, as illustrated in FIG. 4B, the second elastic latch arms 26*b* arranged with the front cover 20 are latched by the cutouts 18*b*, which arranged at the inner housing 10. Furthermore, as illustrated in FIG. 3B, the elastic side locks 26*d*, arranged at the front cover 20, are locked by the locking depressions 18*d* of the inner housing 10.

Then, the retainer 30 is inserted into the retainer receiving depression 17 from the bottom side of the inner housing 10, so as to be locked by the inner housing 10 at the temporary locking position, as illustrated in FIG. 4A and FIG. 4B. When the retainer 30 is locked at the temporary locking position, the contact insertion openings 31 are located at positions in alignment with the contact receiving cavities 13. Also, in this situation, the front cover retaining protrusions 32 of the retainer 30 penetrate through the housing openings 19, respectively, of the inner housing 10 as illustrated in FIG. 4B, and is additionally inserted through the front cover openings 27 of the front cover 20 to regulate the movement in the front-rear direction of the front cover 20. Further, in this case, the retaining pieces 33 of the retainer 30 retain the projection portions 28 arranged at the front cover 20, as illustrated in FIG. 9B and FIG. 9C, to regulate the front-rear movement of the front cover 20.

Next, the second seal 50 is accommodated in the hood 12 from the rear side of the inner housing 10. This tightly attaches the external circumferential surface of the second seal 50 to the inner circumferential surface of the hood 12.

Subsequently, the inner housing 10 to which the first seal 40, the front cover 20, the retainer 30, and the second seal 50 are attached is attached to the outer housing 60. In this case, the housing latch arms 16 provided in the inner housing 10 are latched by the latch arm receiving engagement 62 of the outer housing 60.

Then, a pair of sliders 70 are inserted into the slider receiving grooves 63 from the slider depressions 72 arranged at one end portion and at the opposite end portion.

Next, the pivot 84 of the lever 80 is fit into the pivot receiving portion 64 arranged at one end portion in the widthwise direction of the outer housing 60, and simultaneously, the protrusion for slider movement 85 of the lever 80 is fit into the slider depressions 72 of each slider 70. This causes the lever 80 to be movable both in the arrow B direction illustrated in FIG. 2A and in the arrow C direction illustrated in FIG. 2B, with respect to the outer housing 60, and also causes the sliders 70 to be movable in the slider receiving grooves 63, respectively, in accordance with the turning operation of the lever 80.

Then, multiple contacts connected to the electrical wires are accommodated in the contact receiving cavities 13 of the inner housing 10, respectively, through the electrical wire extending openings 61 and the electrical wire inserting openings 51 of the second seal 50 from the rear side of the outer housing 60. In this situation, the housing lance 15 provided at the inner housing 10 primarily locks each contact.

Subsequently, the retainer 30 is further pushed from the temporary locking position and is locked to the inner housing 10 at the proper locking position. Accordingly, the contacts are secondarily locked to the inner housing 10 by the retainer 30. In this situation, the front cover retaining protrusions 32 of the retainer 30 are inserted through the front cover openings 27 of the front cover 20 to regulate the front-rear movement of the front cover 20. Also, in this case, the retaining pieces 33 of the retainer 30 retain the projection portions 28 arranged at the front cover 20 to regulate the front-rear movement of the front cover 20, as illustrated in FIG. 10B.

Lastly, the wire cover 90 is attached to the rear side of the outer housing 60, so that multiple electrical wires extended from the electrical wire extending openings 61 of the outer housing 60 are further extended to one side of the longitudinal direction of the outer housing 60.

By the above operation, the assembling of the electrical connector 1 is completed.

Herein, as described above, the front cover 20 is retained by the inner housing 10 by means of the locking force of the front cover elastic latch arms 26*a*, the locking force of the projection 26*c* arranged at the front cover 20, the locking force of the second elastic latch arms 26*b* arranged at the front cover 20, and the locking force of the elastic side locks 26*d* arranged at the front cover 20. In addition to the locking forces of the above members, the front cover 20 is retained by the retainer 30 by means of the retaining mechanism arranged with the front cover 20 and the retainer 30. It is therefore possible to increase the retaining force of retaining the front cover 20 as compared to a case where the front cover 20 is retained by only the retaining forces described above. Accordingly, if the electrical connector 1 is dropped off, or when the mating connector is removed after the mating connector and the electrical connector 1 are mated with each other, it is possible to reduce a possibility that the front cover 20 will come off from the inner housing 10.

Then, the retaining mechanism is provided with the front cover retaining protrusions 32 arranged with the retainer 30 and the front cover openings 27 arranged at the upper wall 22*a* of the front cover 20, regulating the front-rear movement of the front cover 20 after the front cover retaining protrusions 32 are inserted through the front cover openings 27 when the retainer 30 is attached to the inner housing 10. For this reason, when the front cover retaining protrusions 32 are inserted through the front cover openings 27, not only does the design regulating the front-rear movement of the front cover 20, it further improves the retaining forces of retaining the front cover 20. That is to say, the lock by use of the front cover elastic latch arms 26*a*, the lock by use of the projections 26*c* arranged at the front cover 20, the lock by use of the second elastic latch arm 26*b* arranged at the front cover 20, and the locking by use of the elastic side locks 26*d* arranged at the front cover 20 are caused by elastic locks by use of the respective members. Therefore, only the above locking force is weak in the retaining force of retaining the front cover 20. If the electrical connector 1 is dropped off, the front cover 20 may be released from the inner housing 10. In contrast, the front cover retaining protrusions 32 of the retainer 30 attached to the inner housing 10 are inserted through the front cover openings 27 defined at the front cover 20 so as to regulate the front-rear movement of the front cover 20, thereby permitting the front cover 20 to be retained in a rigid manner without depending only on the elastic lock. This further improves the retaining force of retaining the front cover 20.

In addition, the retaining mechanism may be further provided as projection portions 28 arranged at the lower part of both of the side walls 22*b* of the front cover 20; and the retaining pieces 33 that are arranged at the lower part of the side walls 30*b* in the retainer 30 and that regulate the front-rear movement of the front cover 20 by retaining the projection portions 28 when the retainer 30 is attached to inner housing 10. Therefore, the retaining pieces 33 arranged at the retainer 30 retain the projection portions 28 arranged at the front cover 20 to regulate the front-rear movement of the front cover 20, thereby further improving the retaining force of retaining the front cover 20. That is to say, the front cover retaining protrusions 32 of the retainer 30 are inserted through the front cover openings 27 defined at the front cover 20 at the upper side of the front cover 20, thereby retaining the front cover 20 in a rigid manner. Conversely, the retaining pieces 33 arranged at the retainer 30 retain the projection portions 28 arranged at the front cover 20 at the lower part of the front cover 20, thereby retaining the front cover 20 in a rigid manner. For these reasons, the retaining force of retaining the front cover 20 is further improved as compared to a case where the front cover retaining protrusions 32 of the retainer 30 are merely inserted through the front cover openings 27 defined at the front cover 20 at the upper side of the front cover 20 so that the front cover 20 is retained in a rigid manner.

Then, the front cover 20 is retained by the retaining mechanism by use of the retainer 30, whereby downsizing of the whole electrical connector 1 is achievable.

Also, multiple locking members for locking the front cover 20 to the inner housing 10, include the front cover elastic latch arms 26*a* of the front cover 20, the housing latching portions 18*a* of the inner housing 10 with which the front cover elastic latch arms 26*a* are latched, the projection 26*c* of the front cover 20, the depression 18*c* of the inner housing 10 with which the projection 26*c* is locked; the second elastic latch arms 26*b* of the front cover 20, the cutouts 18*b* of the inner housing 10 with which the second elastic latch arms 26*b* are latched; the elastic side locks 26*d* of the front cover 20, and the locking depressions 18*d* of the inner housing 10 with which the elastic side locks 26*d* are locked, may be arranged at the front cover 20 and the inner housing 10, thereby further improving the locking forces of locking the front cover 20. In addition, the above-described multiple locking members for locking the front cover 20 with the inner housing 10 are disposed at the front cover 20 and the inner housing 10 in different directions from each other, thereby improving the retaining forces in various directions.

Next, a variation of the electrical connector 1 illustrated in FIG. 1 will be described with reference to FIG. 8 to FIG. 10.

Figure 8:
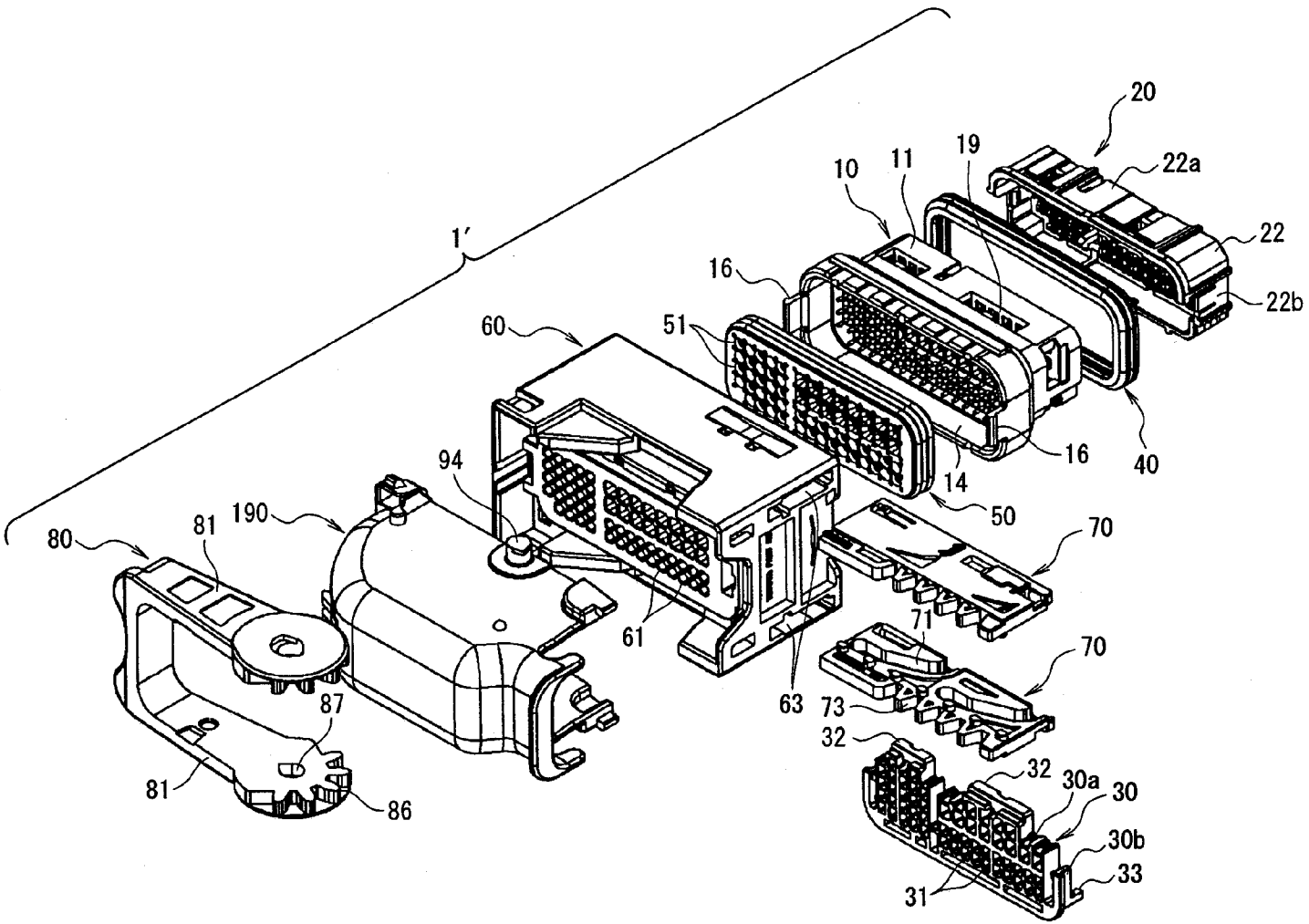
FIG. 8 illustrates an exploded perspective view according to a second embodiment of the electrical connector.

An electrical connector electrical connector 1' illustrated in FIG. 8 to FIG. 10 basically has the same configuration as that of the electrical connector 1 illustrated in FIG. 1. However, the electrical connector 1' has the number of the contacts fewer than that of the electrical connector 1 illustrated in FIG. 1, has a wire cover 190 with a different configuration from that of the electrical connector 1, and has a different configuration for moving the sliders 70 by use of the lever 80 from that of the electrical connector 1. In FIG. 8 to FIG. 10, the same components and configurations as those employed in the electrical connector 1 have the same reference numerals and a detailed explanation will be omitted.

Firstly, the wire cover 190 is different from the wire cover 90 illustrated in FIG. 1. The wire cover 190 is formed by an integrating member, and is provided with a supporting shaft portion 94 for rotatably supporting the lever 80 at its top and bottom surfaces. Each of a pair of the sliders 70 movably accommodated in the slider receiving grooves 63 of the outer housing 60 is provided with racks 73 at its rear end edge. In addition, a shaft opening 87 is defined at the inner surface of an end portion of the arms 81 in the lever 80 so that the supporting shaft portion 94 of the wire cover 190 rotatably supports the lever 80. Further, a pinion 86 meshing with the racks 73 of the slider 70 is provided at an end portion of the arms 81. The electrical connector 1' is different from the electrical connector 1 in that the electrical connector 1' has a rack-and-pinion structure, whereby the sliders 70 are moved by the lever 80.

Incidentally, in the electrical connector 1', the front cover 20 is retained by the retainer 30 by use of the retaining mechanism arranged at the front cover 20 and the retainer 30.

For this reason, if the electrical connector 1' is dropped off or when the mating connector is removed after the mating connector and the electrical connector 1' are mated with each other, it is possible to reduce a possibility that the front cover 20 will come off from the inner housing 10.

In addition, like the electrical connector 1, as illustrated in FIG. 9A and FIG. 10A, the retaining mechanism is provided with the front cover retaining protrusions 32 arranged at the retainer 30; and the front cover openings 27 that is arranged at the upper wall 22*a* of the front cover 20 and that regulates the front-rear movement of the front cover 20 after the front cover retaining protrusions 32 are inserted through the front cover openings 27 when the retainer 30 is attached to the inner housing 10. For this reason, the front cover retaining protrusions 32 of the retainer 30 attached to the inner housing 10 are inserted through the front cover openings 27 defined at the front cover 20, thereby regulating the front-rear movement of the front cover 20 and further improving the retaining forces of retaining the front cover 20.

Furthermore, like the electrical connector 1, as illustrated in FIG. 9B and FIG. 10B, the retaining mechanism may be further provided with the projection portions 28 arranged at the lower part of both of the side walls 22*b* of the front cover 20 and the retaining pieces 33 that is arranged at the lower part of the side walls 30*b* in the retainer 30 and that regulates the front-rear movement of the front cover 20 by retaining the projection portions 28, when the retainer 30 is attached to the inner housing 10. Therefore, the retaining pieces 33 arranged at the retainer 30 retain the projection portions 28 arranged at the front cover 20 to regulate the front-rear movement of the front cover 20, thereby further improving the retaining force of retaining the front cover 20.

As described heretofore, while the embodiments of the present invention have been illustrated in detail, it should be apparent that modifications and adaptations to those embodiments may occur.

For instance, the electrical connector 1 and the electrical connector 1' have been described as what is called a lever-type electrical connector provided with the lever 80 and the sliders 70. However, the present invention is not limited to the lever-type connector, as long as the electrical connector is provided with a housing that has contact receiving cavities 13, a front cover 20 that is attached to the front side of the housing and that has a front cover 20 with inserting openings into which the mating connector is inserted, at positions opposite to the contact receiving cavities 13, and a retainer 30 that locks the contacts accommodated in the contact receiving cavities 13.

Also, the retaining mechanism is not limited to only include the front cover retaining protrusions 32 arranged at the retainer 30, the front cover openings 27 defined at the upper wall 22*a* of the front cover 20, the projection portions 28 arranged at the lower part of both the side walls 22*b* in the front cover 20, and the retaining pieces 33 arranged at the lower part of the side walls 30*b* in the retainer 30, as long as the retaining mechanism is provided with the front cover 20 and the retainer 30 in order to cause the retainer 30 to hold the front cover 20.

What is claimed is:

1. An electrical connector comprising:

an inner housing having contact receiving cavities;

a front cover attached to a front side of the inner housing and having mating connector insertion openings at positions that correspond to the contact receiving cavities;

a retainer attached from a lower side of the inner housing and locking contacts in the contact receiving cavities, and a retaining mechanism arranged to maintain connection of the retainer with the front cover, wherein the retaining mechanism comprises: a front cover retaining protrusions arranged at the upper end surface of the retainer; and front cover openings arranged at the upper wall of the front cover and regulating a front-rear movement of the front cover retaining protrusions are inserted through the front cover openings when the retainer is attached to the inner housing.

2. The electrical connector according to claim 1, wherein the retaining mechanism comprises:

projecting portions arranged at a lower part of both of side walls of the front cover; and retaining pieces arranged at the lower part of both of side walls in the retainer that hold the projecting portions, when the retainer is attached to the inner housing, so as to regulate a front-rear movement of the front cover.

3. The electrical connector according to claim 1, further comprising multiple locking members disposed on the front cover and the inner housing in different directions from each other, thereby improving the retaining forces in various directions.

4. The electrical connector according to claim 3, wherein the locking members comprise:

front cover elastic latch arms; and housing latching portions of the inner housing with which the front cover elastic latch arms are latched.

5. The electrical connector according to claim 4, wherein the locking members further comprises:

a projection of the front cover; and a depression of the inner housing with which a projection is locked.

6. The electrical connector according to claim 5, wherein the locking members further comprises:

second elastic latch arms of the front cover; and cutouts of the inner housing with which the second elastic latch arms are latched.

7. The electrical connector according to claim 5, wherein the locking members further comprises:

elastic side locks of the front cover; and locking depressions of the inner housing with which the elastic side locks are locked.

8. The electrical connector according to claim 1, wherein when the retainer is located at a temporary locking position, contacts are inserted into the contact receiving cavities, so that the contacts are locked by a housing lance.

9. The electrical connector according to claim 8, wherein when the retainer is made to move to a proper locking position, the contacts are consequently locked to the inner housing by the retainer.

10. The electrical connector according to claim 1, further comprising an outer housing, a pair of sliders, a lever, and a wire cover.

11. The electrical connector according to claim 10, wherein the outer housing is integrally formed by molding an insulating resin having a substantial rectangular parallelepiped shape that extends in the widthwise direction, in the up-and-down direction, and in a front-rear direction.

12. The electrical connector according to claim 11, wherein the outer housing is provided at the rear surface of the outer housing a latch arm receiving engagement to be engaged by housing latch arms provided in the inner housing.

13. The electrical connector according to claim 10, wherein each of the sliders is formed to have a substantial plate shape, and is movably accommodated in a slider receiving groove of the outer housing.

14. The electrical connector according to claim 13, wherein the wire cover is formed by an integrating member, and is provided with a supporting shaft portion for rotatably supporting the lever at its top and bottom surfaces.

15. The electrical connector according to claim 10, wherein the wire cover comprises a lower cover and an upper cover that is attached to the lower cover, the wire cover attaching to the rear side of the outer housing, so that multiple electrical wires extended from electrical wire extending openings of the outer housing are further extended to one side of the outer housing in the widthwise direction.

16. The electrical connector according to claim 1, wherein the electrical connector further comprises a rack-and-pinion structure, whereby sliders are moved by a lever.

* * * * *

UNITED STATES PATENT AND TRADEMARK OFFICE

CERTIFICATE OF CORRECTION

PATENT NO. : 8,007,298 B2
APPLICATION NO. : 12/525183
DATED : August 30, 2011
INVENTOR(S) : Ryuichi Komiyama et al.

It is certified that error appears in the above-identified patent and that said Letters Patent is hereby corrected as shown below:

In the Claims

In column 12, line 3, “mechanism comprises a front cover” should read --mechanism comprises front cover--.

In column 12, line 7, “the front cover retaining protrusions” should read --the front cover after the front cover retaining protrusions--.

Signed and Sealed this
Twelfth Day of August, 2014

Michelle K. Lee

Michelle K. Lee
*Deputy Director of the United States Patent and Trademark Office*